United States Patent [19]

Ohgami et al.

[11] Patent Number: 4,498,441

[45] Date of Patent: Feb. 12, 1985

[54] AIR-FUEL RATIO CONTROL SYSTEM

[75] Inventors: Masaaki Ohgami; Mitsuo Nakamura, both of Tokyo, Japan

[73] Assignee: Fuji Jukogyo Kabushiki Kaisha, Tokyo, Japan

[21] Appl. No.: 308,708

[22] Filed: Oct. 5, 1981

[30] Foreign Application Priority Data

Oct. 13, 1980 [JP] Japan ..... 55-142817

[51] Int. Cl.[3] ..... F02M 7/24

[52] U.S. Cl. ..... 123/440

[58] Field of Search ..... 123/440, 489

[56] References Cited

U.S. PATENT DOCUMENTS

| | | | |
|---|---|---|---|
| 4,089,313 | 5/1978 | Asano et al. | 123/489 X |
| 4,142,482 | 3/1979 | Asano et al. | 123/489 X |
| 4,144,847 | 3/1979 | Hosaka | 123/440 |
| 4,187,812 | 2/1980 | Hosaka et al. | 123/440 |

*Primary Examiner*—Tony M. Argenbright

*Attorney, Agent, or Firm*—Martin A. Farber

[57] ABSTRACT

An air-fuel ratio control system for an internal combustion engine having an emission control system with a three-way catalytic converter for controlling the air-fuel ratio in accordance with the operation of the engine. A throttle sensor for detecting acceleration of the engine and a predetermined voltage supply device are provided. A feedback control circuit is provided for controlling the air-fuel ratio to the stoichiometric air-fuel ratio in a normal operating condition and for stopping the control operation when the acceleration of the engine is detected by the throttle sensor. A first switch is provided to be actuated by the output of the throttle sensor to connect the output of the predetermined voltage supply with the input of the feedback control circuit when acceleration is detected. A second switch is provided to be actuated by the output of the throttle sensor to render the feedback control circuit inoperative as a feedback controller, whereby the air-fuel ratio is controlled by the output of the predetermined voltage supply.

10 Claims, 7 Drawing Figures

AIR-FUEL RATIO CONTROL SYSTEM

BACKGROUND OF THE INVENTION

The present invention relates to a system for controlling the air-fuel ratio for an internal combustion engine emission control system having a three-way catalyst, and more particularly to a system for controlling the air-fuel ratio so as to effectively operate the three-way catalyst.

Such a system is a feedback control system, in which an $O_2$-sensor is provided to sense the oxygen content of the exhaust gases to generate an electrical signal as an indication of the air-fuel ratio of an air-fuel mixture supplied by a carburetor. The control system comprises a comparator for comparing the output signal of the $O_2$-sensor with a predetermined value, a proportional and integrating circuit connected to the comparator, a driving circuit for producing square wave pulses from the output signal of the proportional and integrating circuit, and an on-off type electromagnetic valves for correcting the air-fuel ratio of the mixture. The control system operates to determine whether the feedback signal form the $O_2$-sensor is higher or lower than the predetermined value corresponding to a stoichiometric air-fuel ratio for producing an error signal for actuating the one-off electromagnetic valve to thereby control the air-fuel ratio of the mixture.

In such a control system, if the engine is rapidly accelerated, the oxygen concentration of the exhaust gases is greatly deviated from a standard value corresponding to the stoichiometric air-fuel ratio. In order to cause the large deviation to quickly converge, the acceleration is detected and a shift signal depending on the detected acceleration is applied to the proportional and integrating circuit without waiting for the signal from the $O_2$-sensor corresponding to the large deviation. The shift signal causes an error signal to greatly shift, so that the air-fuel ratio of the mixture may be greatly shifted to control the oxygen concentration of the exhaust gases to the standard value. When the acceleration finishes, the shift signal disappears and the system returns to the feedback control operation. However, if the control operation for correcting the deviation of the concentration of the exhaust gases delays, the feedback control operation starts before the correction of the deviation. Therefore, the oxygen concentration of the exhaust gases is controlled at the deviated value. Consequently, the correction of the deviation of the oxygen concentration is delayed.

SUMMARY OF THE INVENTION

An object of the present invention is to provide a system for controlling the air-fuel ratio which rapidly controls the deviation of the oxygen concentration of the exhaust gases to a standard value.

According to the present invention, there is provided an improvement in a system for an internal combustion engine having an induction passage, a carburetor, an electromagnetic valve for correcting the air-fuel ratio of the air-fuel mixture supplied to said carburetor, an $O_2$-sensor for detecting the oxygen concentration of the exhaust gases, and a feedback control circuit, comprising a proportion and integration circuit, responsive to the output of said $O_2$-sensor for producing a control output signal for driving said electromagnetic valve for correcting the air-fuel ratio. The improvement comprises: a detecting means for detecting the operation of said engine for producing an output signal when the throttle valve of the engine is widely opened; a one-shot multivibrator responsive to said output signal of said detecting means for producing an output signal for a predetermined period; voltage apply means for applying a predetermined voltage to an input of the feedback control circuit; first switch means responsive to said output signal of said detecting means to connect output of said voltage apply means with the input of said feedback control circuit; and second switch means responsive to said output signal of said detecting means to render said feedback control circuit inoperative as a feedback controller and operative as an amplifier for input voltage from said voltage apply means.

Other objects and features will be explained more in detail with reference to the accompanying drawings showing a preferred embodiment of the present invention.

DETAILED DESCRIPTION OF THE PREFERRED EMBODIMENTS

Figure 1:
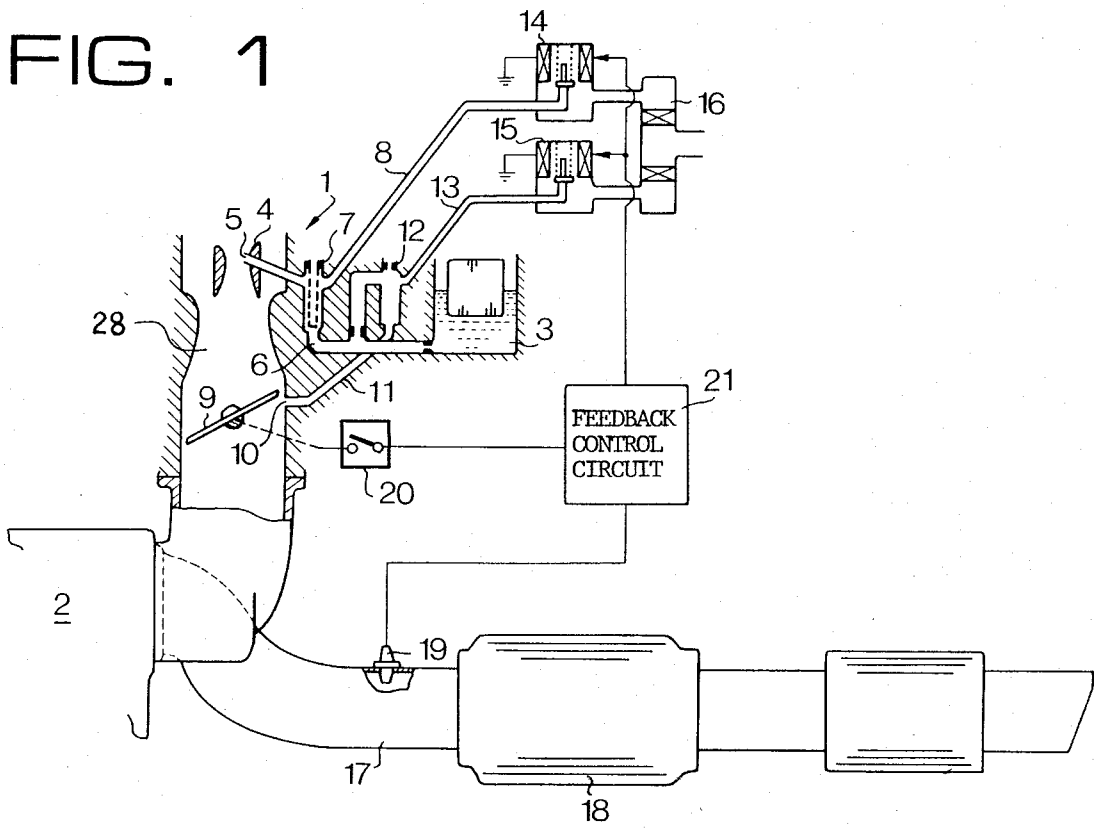
FIG. 1 is a schematic explanatory view of an air-fuel ratio control system.

Referring to FIG. 1 showing schematically an air-fuel ratio control system, the reference numeral 1 designates a carburetor provided upstream an engine 2, a passage 8 for correction air communicating with an air-bleed 7 which is provided in a main fuel passage 6 between a float chamber 3 and a nozzle 5 in a venturi 4. Another passage 13 for correction air communicates with another air-bleed 12 which is provided in a slow fuel passage 11 which diverges from the main fuel passage 6 and extends to a slow port 10 opening in the vicinity of a throttle valve 9 in the induction passage 28. These correction air passages 8 and 13 are communicated with respective electromagnetic valves 14, 15, induction side of which are communicated with atmosphere through an air cleaner 16. Further, a three-way catalytic converter 18 is provided in an exhaust pipe 17 downstream of the engine, and an $O_2$-sensor 19 is provided between the engine 2 and the converter 18 to detect the oxygen concentration of the exhaust gases as the air-fuel ratio of the mixture is burned in the cylinders of the engine. A throttle sensor 20 is provided to detect a wide throttle open operation over a predetermined opening angle.

Figure 2:
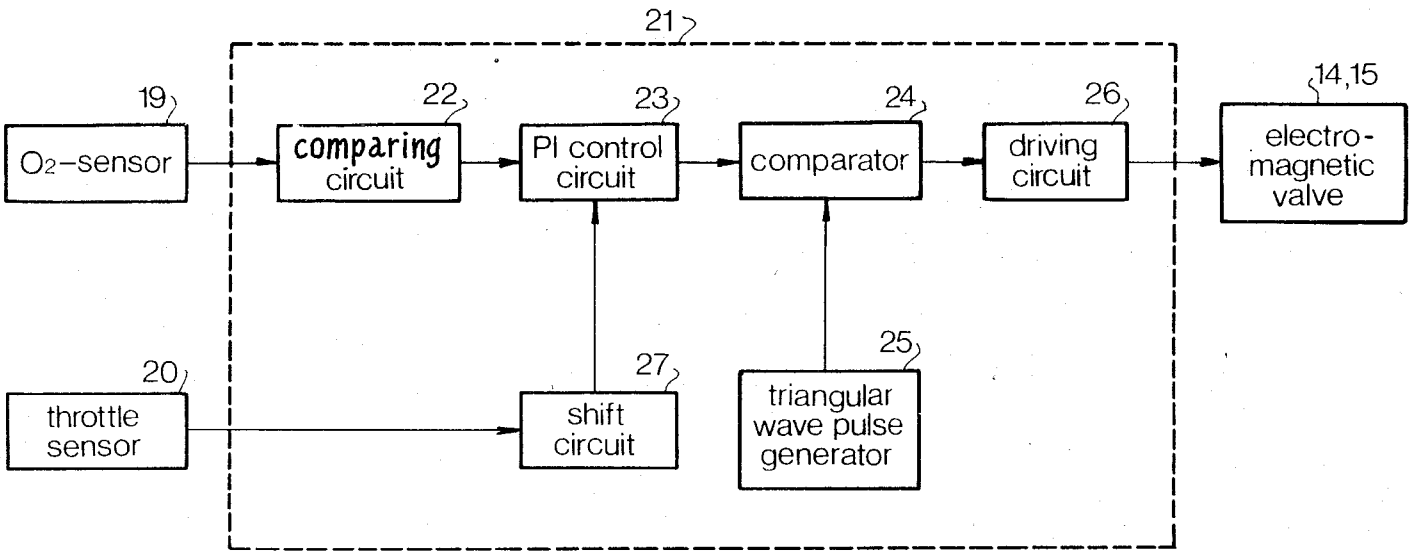
FIG. 2 (PRIOR ART)
FIG. 2 is a block diagram showing a conventional control circuit.

A feedback control circuit 21 is applied with outputs from these sensors 19 and 20 and produces an output signal to actuate the electromagnetic valves 14, 15 to open and close at a certain duty ratio according to the output signal. The air-fuel ratio is made lean by supplying correction air to the carburetor at a great feed rate and the air-fuel ratio is made rich by reducing the correction air supply, Referring to FIG. 2 which is a block diagram showing the conventional control circuit 21, the output of the $O_2$-sensor 19 is applied to a PI (proportion and integration) control circuit 23 through a comparing circuit 22 comprising a comparator; an output of the PI control circuit 23 is applied to a comparator 24; and a triangular wave signal from a triangular wave pulse generator 25 is applied to the comparator 24 for producing square wave pulses. A driving circuit 26 is applied with the square wave pulses from the comparator 24 to drive the electromagnetic valves 14, 15 at the duty ratio of the square wave pulses. The detecting signal of the throttle sensor 20 is applied to the PI control circuit 23 through a shift circuit 27.

Figure 3:
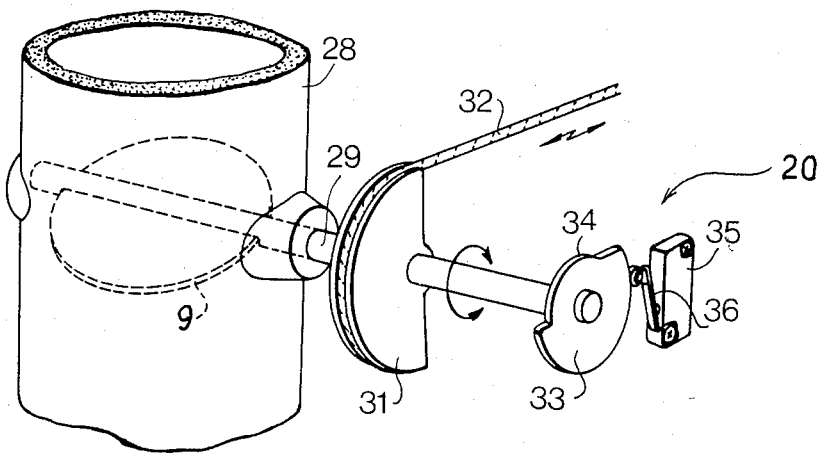
FIG. 3 is a perspective view of a throttle sensor used in a system of the present invention.

Referring to FIG. 3 showing the throttle sensor 20, a throttle shaft 29 is rotatably supported in the induction passage 28, on which the throttle valve 9 is secured. The throttle shaft 29 extends outwardly, on which a wire drum 31 with an accelerator wire 32 and a cam plate 33 having a lower portion 34 are mounted. A microswitch 35 is provided such that a lever 36 is actuated by the lower portion 34 when the throttle valve 9 is widely opened beyond a predetermined angle.

Figure 4:
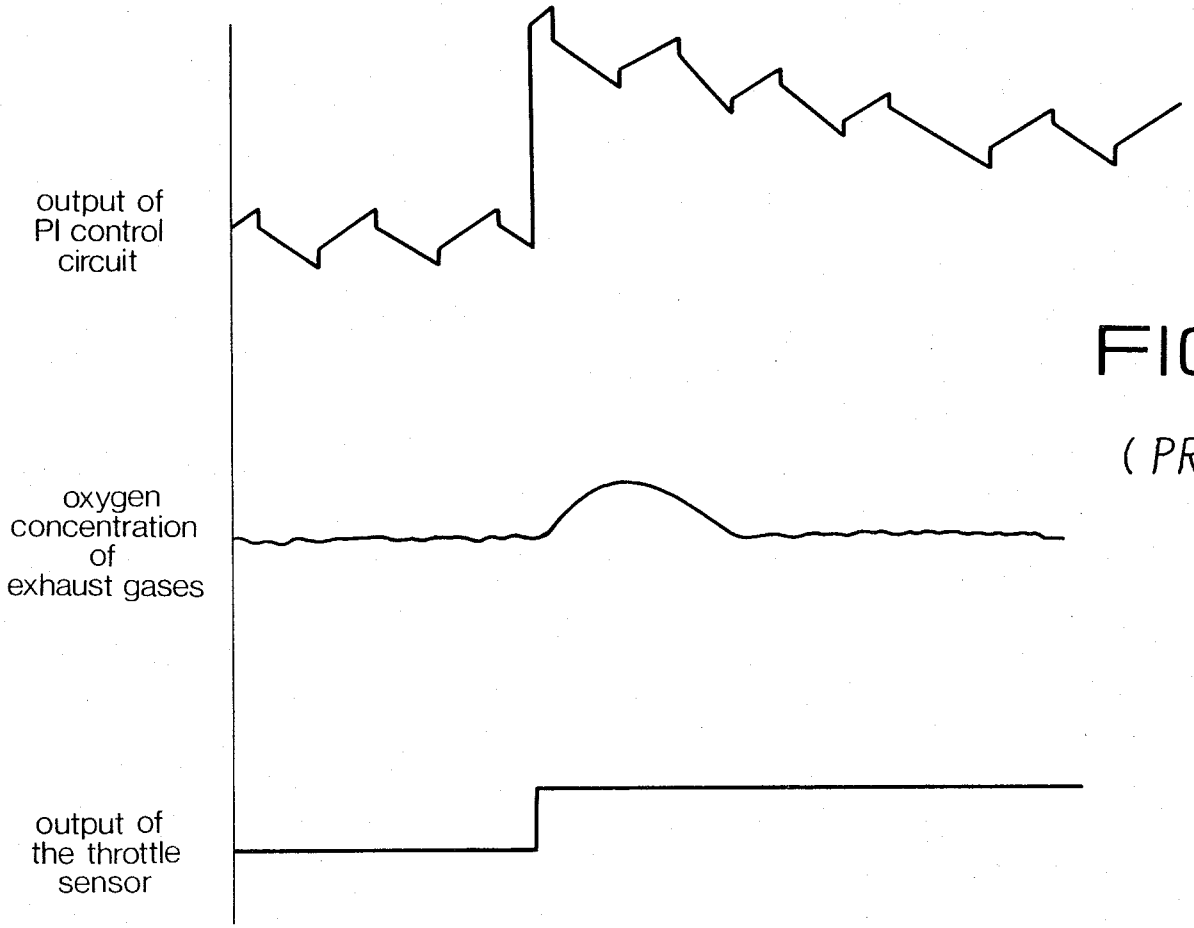
FIG. 4 (PRIOR ART)
FIG. 4 is a graph showing variations of signals at various locations in the system of the conventional control circuit.

The output from the $O_2$-sensor 19 for detecting the oxygen concentration in the exhaust gases is applied to the comparing circuit 22, where the oxygen concentration is compared to determine if it is richer or leaner than the standard value. The output of the comparing circuit is applied to the PI control circuit 23 to produce a feedback signal. The feedback signal is changed to the square wave pulses which are applied to the electromagnetic valves 14, 15 through the driving circuit 26 for controlling the correction air to the carburetor. The output signal of the PI control circuit 23 and the variation of the air-fuel ratio are shown in FIG. 4.

When an accelerator pedal (not shown), which is operatively connected to the accelerator wire 32, is greatly depressed and the throttle valve 9 is widely opened, the microswitch 35 is actuated by the lower portion 34 of the cam plate 33 to produce an output signal. The output signal is applied to the shift circuit 27 to produce a shift signal which is applied to the PI control circuit 23. Thus, the feedback signal from the PI control circuit is shifted as shown in FIG. 4. If the control operation for correcting the deviation by the shifted feedback signal is delayed, the deviation of the oxygen concentration is not corrected and the oxygen concentration is controlled by the feedback operation at the deviated value. Accordingly, the correction of the deviation is delayed. FIG. 4 shows such a delay. The present invention is to remove such a disadvantage of the conventional control system.

Figure 5:
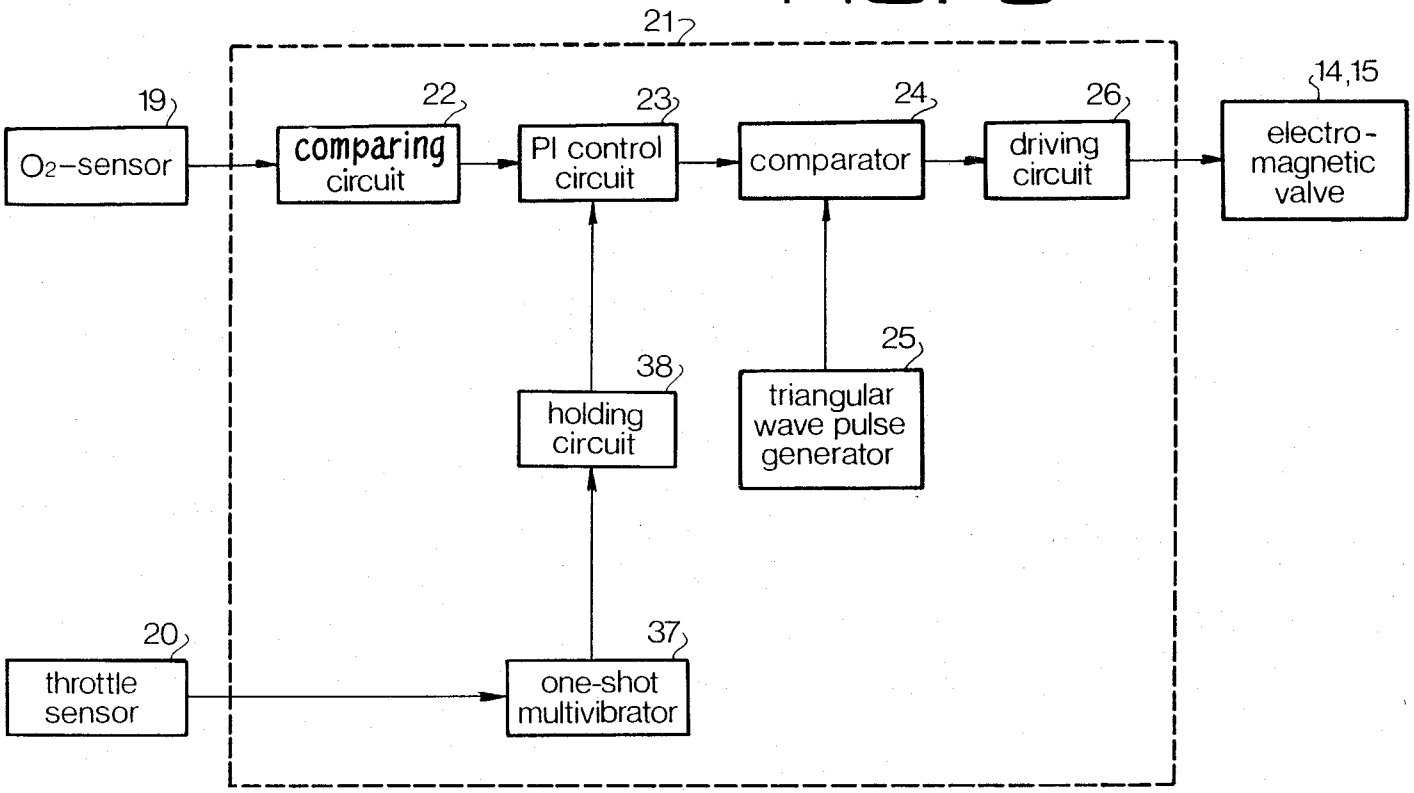
FIG. 5 is a block diagram of a control system of the present invention.

Referring to FIG. 5, the output of the throttle sensor 20 is connected to a one-shot multivibrator 37, the output of which is connected to the PI control circuit 23 through a holding circuit 38.

Figure 6:
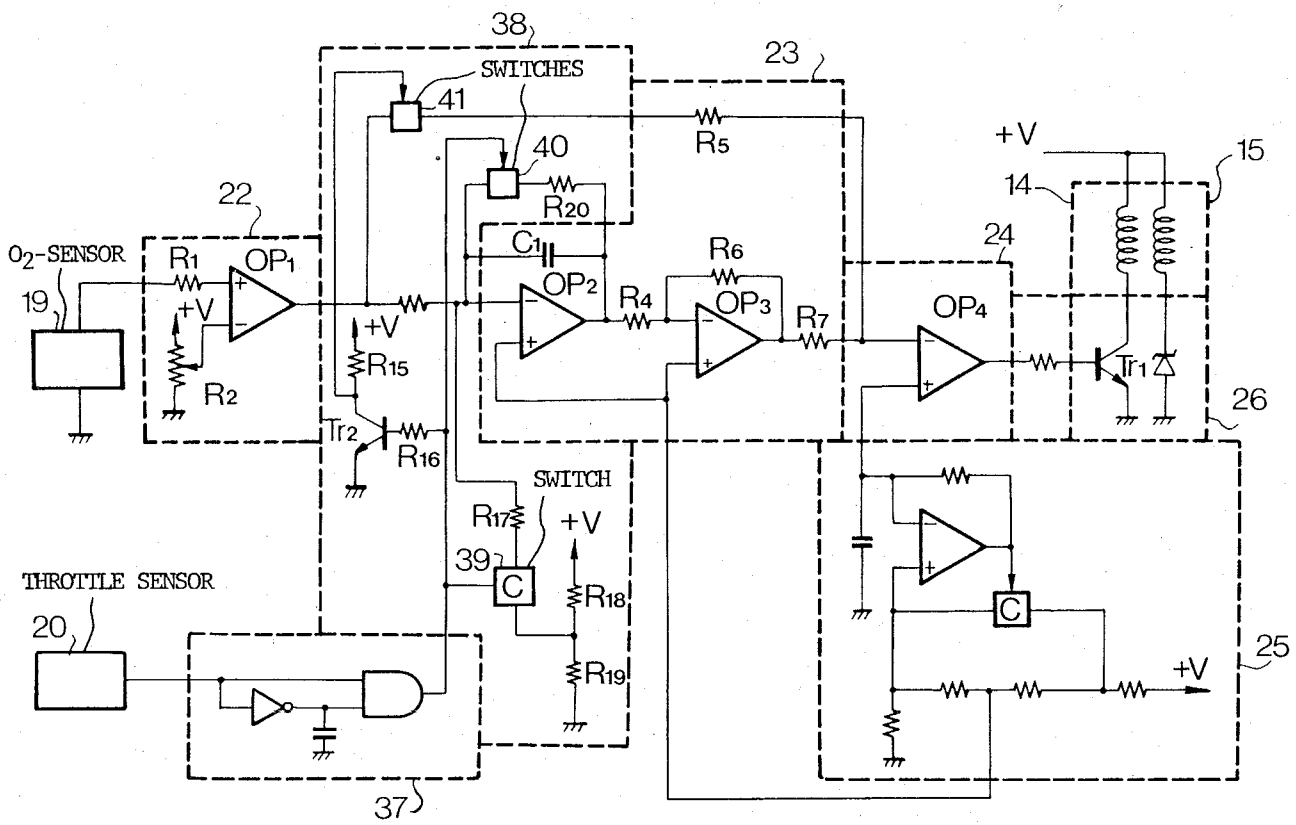
FIG. 6 is an electric circuit embodying the same.

Referring to FIG. 6, the output of the one-shot multivibrator 37 is connected to control gates of switch circuits 39 and 40 of a holding circuit 38 and is also connected to the base of a transistor $Tr_2$ through a resistor $R_{16}$. The collector of the transistor $Tr_2$ is connected to the control gate of a switch circuit 41. Supply voltage is divided by resistors $R_{18}$ and $R_{19}$ and applied to the input of the PI control circuit 23 through the switch circuit 39 and resistor $R_{17}$. The PI control circuit 23 comprises operational amplifiers $OP_2$ and $OP_3$, a capacitor $C_1$ and resistors $R_4$, $R_5$, $R_6$ and $R_7$. Both ends of the capacitor $C_1$ are connected in parallel by a series connection of the switch circuit 40 and a resistor $R_{20}$. Further, the output of the PI control circuit 23 is connected to the input thereof through the switch circuit 41 and resistor $R_5$ in series therewith.

In operation, the output of the $O_2$-sensor 19 corresponding to the air-fuel ratio of the mixture is applied to an operational amplifier $OP_1$ through a resistor $R_1$ and compared with a standard value set by a variable resistor $R_2$. The output of the operational amplifier $OP_1$ is integrated and amplified by the operational amplifier $OP_2$ and $OP_3$. The output of the operational amplifier $OP_3$ is compared with triangular pulses from the triangular wave pulse generating circuit 25 in an operational amplifier $OP_4$, so that square wave pulses are produced. The square wave pulses operate a transistor $TR_1$ in the driving circuit 26 for actuating the electromagnetic valves 14 and 15.

When acceleration caused by a throttle opening angle over the predetermined angle is detected by the throttle sensor 20, the output of the sensor 20 actuates the one-shot multivibrator 37 which produces a high level output for a period of time. The high level output actuates switch circuits 39 and 40 to close the circuits and turns on the transistor $Tr_2$ causing the switch circuit 41 to turn off. Thus, the operational amplifier $OP_2$ fails to function as an integrator and the PI control circuit 23 acts as a mere amplifier. Since the voltage divided by resistors $R_{18}$ and $R_{19}$ is applied to the operational amplifier $OP_2$ through the switch circuit 39, the output of the PI control circuit 23 is kept at a constant voltage. Thus, the duty ratio of the square pulses produced from the operational amplifier $OP_4$ is fixed to a predetermined value (for example 40%). The duty ratio is selected to a value sufficient to correct the deviation of the oxygen concentration of the exhaust gases.

Figure 7:
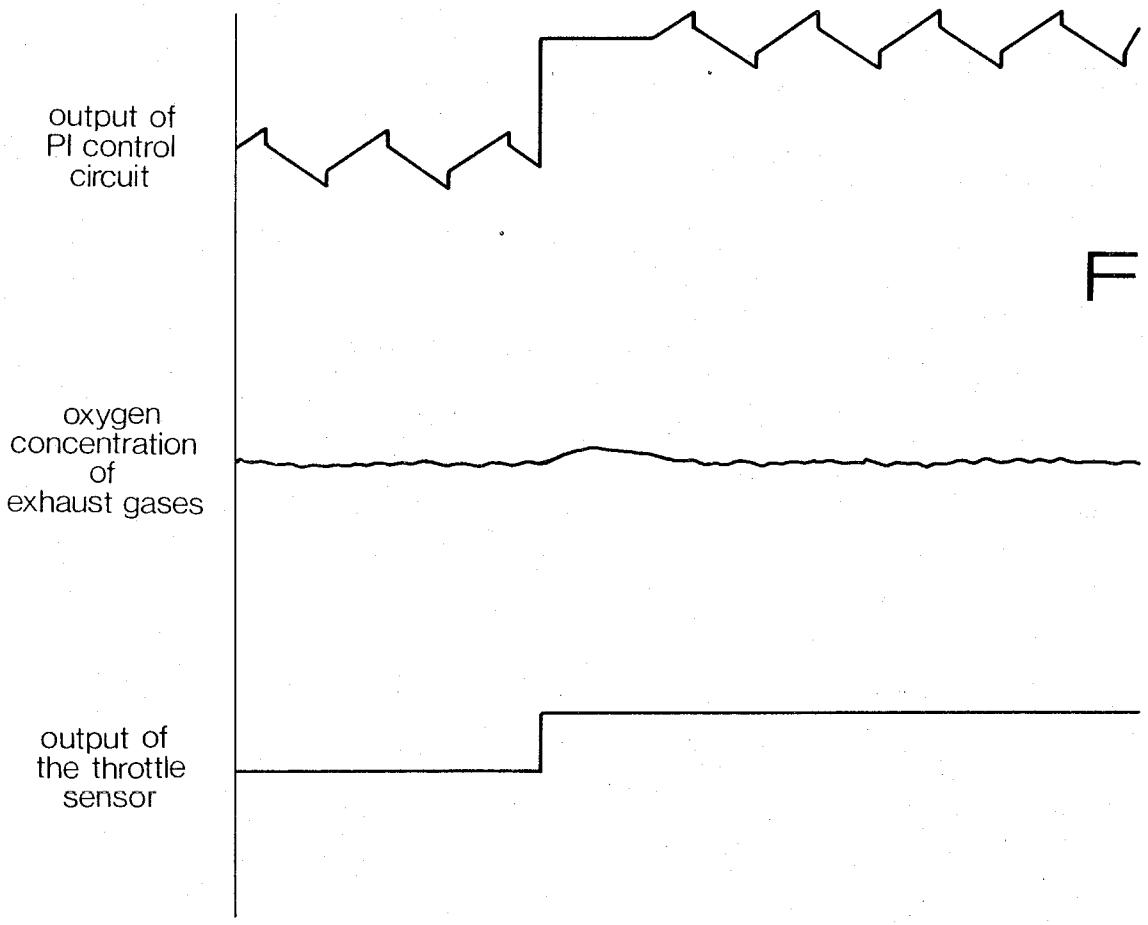
FIG. 7 is a graph showing signals of the system of the present invention.

When the output of the one-shot multivibrator 37 changes to a low level, the switch circuits 39 and the 40 are opened and switch circuit 41 is closed. Thus, the PI control circuit 23 operates again as the integrator as described above. FIG. 7 shows the relation between the output of the PI control circuit and the oxygen concentration of the exhaust gases. From the graphs, it will be understood that the variation of the exhaust gas concentration may quickly converge.

What is claimed is:

1. In an air-fuel ratio control system for an internal combustion engine having an induction passage, a throttle valve in the induction passage, a carburetor, an electromagnetic valve means for correcting the air-fuel ratio of the air-fuel mixture supplied to said carburetor, an $O_2$-sensor for detecting oxygen concentration of exhaust gases from the engine, and a feedback control circuit comprising a proportion and integration circuit responsive to the output of said $O_2$-sensor for producing a control output signal for driving said electromagnetic valve means for correcting the air-fuel ratio; the improvement comprising detecting means for detecting the operation of said engine for producing an output signal when the throttle valve of the engine is widely opened;

means comprising a one-shot multivibrator responsive to said output signal of said detecting means for producing another output signal for a fixed predetermined period always the same;

voltage applying means for continuously applying a fixed predetermined voltage always the same to said feedback control circuit when said voltage applying means is connected to said feedback control circuit;

first switch means responsive to said another output signal of said one-shot multivibrator for connecting said voltage applying means with said feedback control circuit; and second switch means responsive to said another output signal of said one-shot multivibrator for rendering said integration circuit operative as an amplifier for said predetermined voltage from said voltage applying means.

2. The air-fuel ratio control system for an internal combustion engine in accordance with claim 1 wherein said second switch means is for rendering said proportion and integration circuit inoperative as an integrator and operative as said amplifier.

3. The air-fuel ratio control system for an internal combustion engine in accordance with claim 1, wherein said integration circuit includes a capacitor, said second switch means comprises a third switch connecting the output of said feedback control circuit to said input terminal via resistors, and a fourth switch connected in series to another resistor in a line connected in parallel to said capacitor, and said first switch means and said third and fourth switches have gates operatively connected to said one-shot multivibrator.

4. The air-fuel ratio control system for an internal combustion engine in accordance with claim 3, further comprising a transistor is connected between said one-shot multivibrator and the gate of said third switch.

5. The air-fuel ratio control system for an internal combustion engine in accordance with claim 3, wherein said first switch means and said fourth switch are normally open and said third switch is normally closed.

6. The air-fuel ratio control system for an internal combustion engine in accordance with claim 5, wherein said first switch means and said fourth switch are closed and said third switch is open when the throttle valve of the engine is widely opened.

7. The air-fuel ratio control system for an internal combustion engine in accordance with claim 1, wherein said one-shot multivibrator comprises an AND-gate having an output providing said another output signal and a first input connected to said detecting means, an inverter connected between said detecting means and the other input of said AND-gate, and a grounded capacitor connected to said other input of said AND-gate.

8. The air-fuel ratio control system for an internal combustion engine in accordance with claim 1, wherein said predetermined voltage is selected to a value sufficient to correct a deviation of the oxygen concentration of the exhaust gases, the deviation occurring upon widely opening the throttle valve.

9. The air-fuel ratio control system for an internal combustion engine in accordance with claim 8, wherein said value provides a duty ratio of the control output signal of 40%.

10. The air-fuel ratio control system for an internal combustion engine in accordance with claim 1, wherein said predetermined voltage is such that the output of said amplifier is held to a predetermined fixed value during said predetermined period determined by said one-shot multivibrator.

* * * * *